US007806703B2

(12) United States Patent
Wallrafen

(10) Patent No.: US 7,806,703 B2
(45) Date of Patent: Oct. 5, 2010

(54) COMPONENT PART HAVING AN ELECTRICAL PRINTED CIRCUIT BOARD

(75) Inventor: Werner Wallrafen, Hofheim (DE)

(73) Assignee: Continental Automotive GmbH, Hannover (DE)

( * ) Notice: Subject to any disclaimer, the term of this patent is extended or adjusted under 35 U.S.C. 154(b) by 278 days.

(21) Appl. No.: 12/160,661

(22) PCT Filed: Dec. 18, 2006

(86) PCT No.: PCT/EP2006/069813

§ 371 (c)(1),
(2), (4) Date: Jul. 11, 2008

(87) PCT Pub. No.: WO2007/082617

PCT Pub. Date: Jul. 26, 2007

(65) Prior Publication Data

US 2010/0190362 A1 Jul. 29, 2010

(30) Foreign Application Priority Data

Jan. 13, 2006 (DE) ..... 10 2006 001 876

(51) Int. Cl.
*H01R 12/00* (2006.01)

(52) U.S. Cl. ..... 439/81

(58) Field of Classification Search ..... 439/81, 439/82, 248, 76.2, 857, 404, 406; 361/737
See application file for complete search history.

(56) References Cited

U.S. PATENT DOCUMENTS 4,738,631 A 4/1988 Takahashi et al. ..... 439/248
5,478,244 A 12/1995 Maue et al. ..... 439/76.2
5,548,484 A 8/1996 Kantner ..... 361/737
5,634,830 A 6/1997 Weingartner ..... 439/857
5,723,902 A * 3/1998 Shibata et al. ..... 257/692
5,878,890 A * 3/1999 Kaneko ..... 206/714
5,975,915 A * 11/1999 Yamazaki et al. ..... 439/72
6,537,111 B2 3/2003 Brammer et al. ..... 439/857
6,849,930 B2 2/2005 Nakajima et al. ..... 257/666
7,112,071 B2 * 9/2006 Nakagawa et al. ..... 439/82
7,344,389 B2 * 3/2008 Kramski ..... 439/82

FOREIGN PATENT DOCUMENTS

DE 37 09 903 A1 10/1987
DE 101 49 574 C2 10/2003
DE 20 2004 006 434 U1 8/2004
DE 20 2004 006 998 U1 8/2004
EP 1 160 925 A2 12/2001
EP 1 191 589 A2 3/2002

* cited by examiner

*Primary Examiner*—Chandrika Prasad
(74) *Attorney, Agent, or Firm*—King & Spalding L.L.P.

(57) ABSTRACT

A component part has an electrical printed circuit board (12), which has an electronic circuit and has been contact-connected to a lead frame (10), which is generally surrounded at least partially by plastic (11), in which first contact elements (14) protrude on the lead frame (10) adjacent to the printed circuit board (12) and are mechanically connected to second contact elements (16) on the printed circuit board (12) via a flexible intermediate region (30), wherein the first and the second contact elements (16) are contact-connected to one another in pairs in such a way that in each case at least one punctiform and/or linear contact region (25, 27) on one contact element (14) interacts with a flat contact region on the other contact element (16) in a clamping connection.

18 Claims, 3 Drawing Sheets

COMPONENT PART HAVING AN ELECTRICAL PRINTED CIRCUIT BOARD

CROSS-REFERENCE TO RELATED APPLICATIONS

This application is a U.S. national stage application of International Application No. PCT/EP2006/069813 filed by Dec. 18, 2006, which designates the United States of America, and claims priority to German application number 10 2006 001 876.1 filed Jan. 13, 2006, the contents of which are hereby incorporated by reference in their entirety.

TECHNICAL FIELD

The present invention concerns a component having an electrical printed circuit board which has an electronic circuit and with which a leadframe makes electrical contact. The present invention also relates to a method for mounting such a component part.

BACKGROUND

Such component parts having electrical printed circuit boards are used, for example, in vehicles as housing halves of actuators in the region of the engine compartment, for example throttle valves, with the electronic circuit forming the driver electronics for the actuator. In this case, the electrical components are generally integrated in the housing of the actuators, which housing also contains the drive of the actuator. To this end, the printed circuit board is arranged in the housing and then connected. In this case, the contact points provided on the printed circuit board are connected to other contacts, this being performed by various techniques, for example soldering or bonding. However, manual soldering of the contacts is highly complex and additionally is a great source of faults in the durability of the solder points. Automated soldering reduces the risk of a defective contact point, but the components in the engine compartment are exposed to increasingly higher temperatures, and this can lead to the solder points wearing away. A further connection technique which can be used is so-called thick-wire bonding. In this process, wires are pressed onto the contact points and connected to the contact points, for example by means of ultrasound, the result being cohesive connection of the two contacts. The use of bonding theoretically permits an improved error rate compared to automated soldering, but there must not be any impurities between the contacts, and for this reason connection of the printed circuit board to the leadframe is carried out by specialist electronics companies where clean-room conditions are available. The process of bonding is therefore also associated with correspondingly high costs. The yet to be completed component part is then transported to other locations in order to install the mechanics and to fully assemble the component part. The preassembled parts may be damaged in the process, and for this reason monitoring of the quality of the contact points is complicated, in order to, as far as possible, detect all faults. Defective contact-connection can lead to failure of the component part, and this may lead, on account of the complex relationships in the engine controller, to an interruption in operation of the vehicle and can be remedied only by replacing the entire component part.

SUMMARY

A component part having an electrical printed circuit board, which component part can be easily installed and connected and ensures reliable, long-lasting contact-connection can be provided according to an embodiment by a component part comprising an electrical printed circuit board which has an electronic circuit and with which a leadframe makes electrical contact, wherein the printed circuit board is fitted on the leadframe and forms a unit with said leadframe, first contact elements which can be plug-connected to second contact elements on the printed circuit board via a flexible intermediate region project from the leadframe next to the printed circuit board, and the first and the second contact elements make contact with one another in pairs in such a way that in each case at least one punctiform and/or linear contact region on one contact element interacts with a flat contact region on the other contact element with a spring-elastic clamping connection, with the flat contact region being in the form of a contact lug on the flexible intermediate region, and the punctiform and/or linear contact regions being formed by two contact tongues which are opposite one another by way of narrow sides which bound a slot, and at least one of the contact tongues being spring-elastic and the slot being elastically widened by the inserted contact lug.

According to a further embodiment, the slot may have a widened portion at its open end. According to a further embodiment, one of the two contact tongues may form a straight, linear contact region, and the other of the two contact tongues may have on its slot flank a projection which forms a round or pointed, punctiform contact region. According to a further embodiment, the second contact element may be in the form of a flat strip which is fastened at its first end to the printed circuit board, may form the flexible intermediate region and at its second end may be turned through approximately 90° in the longitudinal direction and may be inserted into the slot as the contact lug. According to a further embodiment, the edges of the contact lug can be formed with a sharp edge and/or as a burr on that side which was inserted into the slot first. According to a further embodiment, the flexible intermediate region may describe at least one loop. According to a further embodiment, the flexible intermediate region can be damped against oscillations. According to a further embodiment, a support may be provided for the flexible intermediate region. According to a further embodiment, the electrically conductive edge region of the printed circuit board with which contact is made can be arranged at a distance from the leadframe. According to a further embodiment, the first contact elements can be in each case in the form of the contact tongues, and the second contact elements can be in the form of the contact lug with the flexible intermediate region. According to a further embodiment, the leadframe may form continuous electrical connections between the first contact elements and the contacts of an electrical connector which is provided on the outside of the component. According to a further embodiment, the printed circuit board can be held on the leadframe. According to a further embodiment, the leadframe may be in the form of a heat sink at least in the region of the printed circuit board, and the printed circuit board may be connected to the leadframe in a thermally conductive manner. According to a further embodiment, the printed circuit board can be adhesively bonded to the leadframe.

According to another embodiment, a method for mounting an electrical printed circuit board having an electronic circuit on a leadframe which is at least partially surrounded by plastic, may comprise the steps of: fitting the printed circuit board flat on the leadframe, mechanically connecting first contact elements, which project next to the printed circuit board, to second contact elements on the printed circuit board in pairs by means of a flexible intermediate region, and connecting in each case at least one punctiform and/or linear contact region on one contact element to a flat contact region on the other contact element by way of a spring-elastic clamping connection.

According to a further embodiment, the printed circuit board can be fitted on the leadframe and contact can be made with the contact elements in a single working step. According to a further embodiment, the flat contact region, which is in the form of a contact lug on the flexible intermediate region, can be inserted into a slot which is formed by two contact tongues whose narrow sides are opposite one another and which represent punctiform and/or linear contact regions, and the slot can be elastically widened by the inserted lug.

According to another embodiment, a method may use such a component part as a housing cover of an actuator.

BRIEF DESCRIPTION OF THE DRAWINGS

Exemplary embodiments of the invention are discussed in greater detail below with reference to the attached drawings, in which.

DETAILED DESCRIPTION

Figure 1:
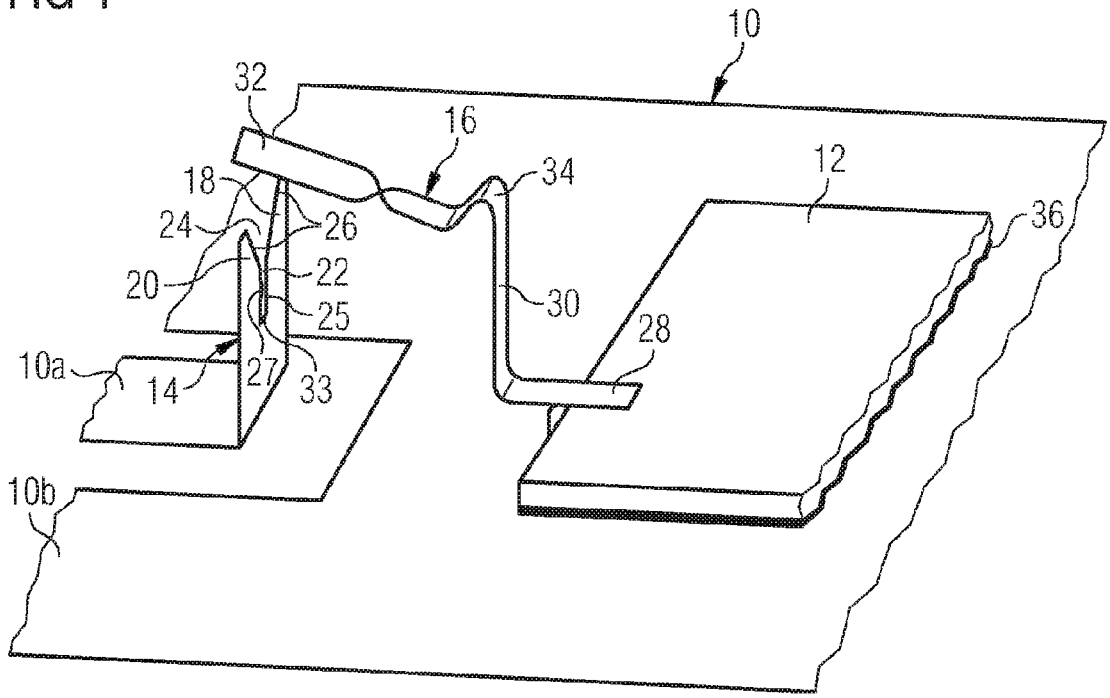
FIG. 1 shows a schematic oblique view of a detail with a clamping connection in the open state.

According to various embodiments, a component part of the type described in the introduction in which first contact elements which can be plug-connected to second contact elements on the printed circuit board via a flexible intermediate region project from the leadframe next to the printed circuit board, with the first and the second contact elements making contact with one another in pairs in such a way that in each case at least one punctiform and/or linear contact region on one contact element interacts with a flat contact region on the other contact element with a spring-elastic clamping connection.

The advantage of the component according to various embodiments is that long-lasting and reliable contact is ensured by the clamping connection to at least one punctiform and/or linear contact region and one flat contact region.

On account of the flexible intermediate region, the contact region is free of mechanical stress and permits mechanical contact-connection without problems. In addition, the risk is minimized of movement being transmitted to the contact region, for example by different temperature expansion behavior or by oscillations, vibrations or vigorous shaking, which affect the housing of the component part. Repeated relative movements in the contact region would lead to wear or frictional corrosion of the contact points, and this would ultimately result in failure of the contact. Connection of the printed circuit board by the clamping connection can be executed in a simple and cost-effective manner, for example when the mechanical parts are installed in the housing of the component part, without special ambient conditions having to be complied with in the process. The printed circuit board is preferably connected to the leadframe by means of at least three contacts. Uninterrupted connection of the contact elements to the housing plug connections is expedient.

In a preferred embodiment, the flat contact region is in the form of a contact lug on the flexible intermediate region, and the punctiform and/or linear contact regions are formed by two contact tongues which are opposite one another by way of narrow sides which bound a slot, with at least one of the contact tongues being spring-elastic and the slot being elastically widened by the inserted contact lug. As a result, the number of parts required is reduced to a minimum. Insertion of the contact lug into the slot additionally produces a simple movement sequence for connection of the printed circuit board, which movement sequence can be easily automated. The spring-elastic contact tongues ensure long-lasting contact-pressure of the clamping and therefore long-lasting contact.

Further preferred is an embodiment in which the slot has a widened portion at its open end, in order to be able to insert the contact lug into the slot more easily. The widened portion has, for example, slopes or rounded portions for insertion. A further widened portion, which is larger than the clear width of the slot at the location of the punctiform and/or linear contact region, can be provided at the closed end of the slot. This ensures that electrical contact is always made by means of the punctiform and/or linear contact regions and undefined contact points are not produced between the two contact partners in the region of the slot base.

One of the two contact tongues preferably forms a straight, linear contact region, and the other of the two contact tongues has on its slot flank a projection which forms a round or pointed, punctiform contact region. This ensures that the contact lug always rests against the punctiform contact region of one side and with the other side is pressed against the linear contact region, so that defined contact points are present.

According to a further embodiment, the second contact element is in the form of a flat strip which is fastened at its first end to the printed circuit board, forms the flexible intermediate region and at its second end is turned through approximately 90° in the longitudinal direction and is inserted into the slot as the contact lug. On account of this one-part design, the second contact element can be produced and mounted in a cost-effective manner.

Fastening and electrical contact-connection to the printed circuit board can be performed, for example, by the end being of U-shaped form and being pushed onto the edge of the printed circuit board. Fixing can be performed by means of soldering or conductive adhesive bonding. Since a flat strip can be deformed substantially more easily perpendicular to its plane than parallel to its plane, a movement which is required for connection of the second contact should also be executed perpendicular to the plane of the strip. Turning of the other end through 90° produces a lug which can be inserted in the direction into a slot in which the strip can be deformed most easily. A suitable material for the strip is, for example, a CuSn alloy which can also be used for the first contact elements. The CuSn alloy can be used without surface treatment. Only a contact region, for example the region of the contact lug, is preferably tin-plated.

In a preferred embodiment, the edges of the contact lug are formed with a sharp edge and/or as a burr on that side which was inserted into the slot first, in order to clean the contact regions of the slot flanks of any impurities, for example corrosion, which may be present by scraping and/or shaving during the insertion process. As a result, problem-free contact-connection is ensured in a simple manner.

In an expedient embodiment, the flexible intermediate region describes at least one loop, so that the contact regions are clamped to one another without mechanical stress. On account of the loops, the contact lug can be inserted into the slot without any tensile loading of the connection being produced at the fastening point of the flexible intermediate region on the printed circuit board. In addition, the second contact element can bridge different distances between the first and the second contact element.

The flexible intermediate region is preferably damped against oscillation, in order to prevent the intermediate region transmitting movements to the contact regions and resonance phenomena being produced if the flexible intermediate region were excited at the frequency of natural oscillation by external oscillation, for example on account of engine vibration or an unbalance in a wheel of the vehicle. In such a case, a continuously repetitive relative movement of the contact regions in relation to one another could also lead to gradual wear of the contact points and therefore to failure of the component part. Oscillation damping may be performed, for example, by elastomers. In order to prevent a movement, a support for the flexible intermediate region can also be provided, said support being arranged laterally next to the flexible intermediate region.

According to a further embodiment, the electrically conductive edge region of the printed circuit board with which contact is made is arranged at a distance from the leadframe, so that a short circuit cannot be produced, for example on account of small fragments of metal swarf, grit from carbon brushes of an electric motor or scaling which can occur over the course of time. The distance can be generated, for example, by a bead being provided in the leadframe in the region of the connections of the printed circuit board. However, the distance can also be created by the region of the leadframe on which the printed circuit board is fitted being raised in relation to the surrounding region and the printed circuit board projecting beyond the protrusion in the region of the connections.

In a particularly preferred embodiment, the first contact elements are in each case in the form of the contact tongues, and the second contact elements are in the form of the contact lug with the flexible intermediate region. As a result, the contact tongues can be produced together with the leadframe which is a type of lattice support which is generally at least partially surrounded by plastic. The leadframe preferably forms continuous electrical connections between the first contact elements and the contacts of an electrical connector which is provided on the outside of the component part, that is to say the contacts of the contact element are integrally formed with the contacts of the connector, in order to minimize the number of contact points. The second contact elements can be fastened to the printed circuit board before installation into the component part. Contact is made between the first contact elements and the second contact elements, by way of example, close to the time at which or at the same time as the printed circuit board is fitted on the leadframe. However, it is also possible to fasten the second contact elements to the printed circuit board when the printed circuit board is arranged on the leadframe.

Also preferred is an embodiment in which the leadframe holds the printed circuit board and said leadframe is further preferably in the form of a heat sink at least in the region of the printed circuit board. The printed circuit board is then connected to the leadframe in a thermally conductive manner. This provides effective and low-cost cooling of the printed circuit board. The printed circuit board is preferably adhesively bonded to the leadframe by way of an adhesive layer or a film or foil which is adhesive on both sides, with the adhesive bond having to be as thermally conductive as possible. The adhesive layer may also be electrically conductive, so that the printed circuit board can be connected to a region of the leadframe, which preferably represents electrical ground, by means of the adhesive layer. The leadframe can then shield the circuit against radiation even without electrical connection to the printed circuit board.

According to another embodiment, in a method for mounting the above-described component part, the electrical printed circuit board is preferably fitted flat on the leadframe and the first contact elements are then, or in the same working step, mechanically connected to the second contact elements in pairs by means of a flexible intermediate region by way of a clamping connection. Simple mounting is achieved by adhesively bonding the printed circuit board on the leadframe. The connection of the at least one punctiform and/or linear contact region on one contact element to the flat contact region on the other contact element ensures simple and reliable contact-connection, which is made by simply mechanically inserting the lug on the flexible intermediate region into the slot formed by two contact tongues, which represent punctiform and/or linear contact regions. In the process, the slot is elastically widened by the inserted lug.

FIG. 1 shows a detail of a leadframe 10 with a printed circuit board 12 arranged on the leadframe 10. The leadframe 10 is a metal lattice structure which is surrounded at least partially by plastic 11. So that delamination does not occur in flat regions of the lattice structure, for example on account of different temperature expansions between the plastic 11 and the metal lattice, holes which provide better anchoring can be provided in the lattice structure, in particular in regions which are subject to a high temperature load. The leadframe 10 has functionally different regions 10*a*, 10*b* which are not electrically connected to one another. A region 10*a* forms, for example directly, a contact 15 of a connector 13 for connecting the component and consequently has the function of an integral, continuous electrical conductor. Another region 10*b* serves to fasten the printed circuit board 12, it being possible for said printed circuit board to be, for example, a printed circuit with electronic circuits mounted on it or a hybrid electronic system in the form of a substrate ceramic with SMD components mounted on it. This region serves as a mount and has the function of heat dissipation (see below). With the exception of the lower face, the electronic circuit is sealed by an insulating layer, for example by a paint-like coating. The leadframe 10 has a projecting first contact element 14 which is connected to a connector. A second contact element 16 is fitted to the printed circuit board 12 and is not yet in contact with the first contact element 14 in FIG. 1.

Figure 4:
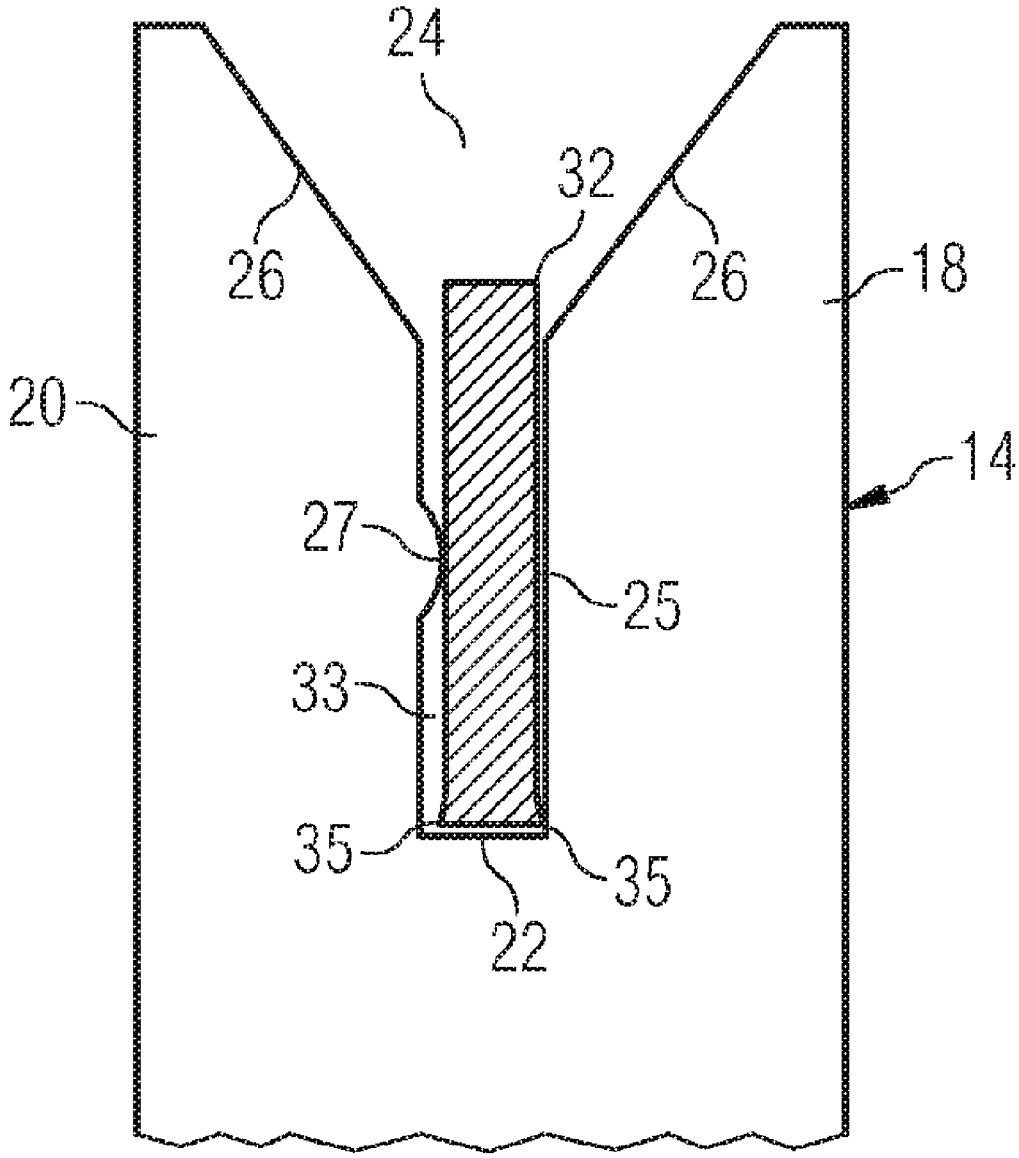
FIG. 4 shows a partial view of the contact tongue of the clamping connection from FIG. 1 with a sectioned contact lug.

The first contact element 14 has a punctiform and/or linear contact region (also see FIG. 4 in this context) which is formed by two contact tongues 18, 20 which are opposite one another by way of narrow sides which bound a slot 22 into which the second contact element 16, which has a flat contact region, can be inserted. At least one of the contact tongues 18, 20 is spring-elastic, so that the slot 22 can be elastically widened. At its open end, the slot 22 has a widened portion 24 in the form of two insertion slopes 26, in order to be able to insert the second contact element 16 into the slot 22 more easily. A contact tongue 18 forms a linear contact region 25 and the other contact tongue 20 has, on its slot flank, a projection 27 which forms a round or pointed, punctiform contact region.

Figure 2:
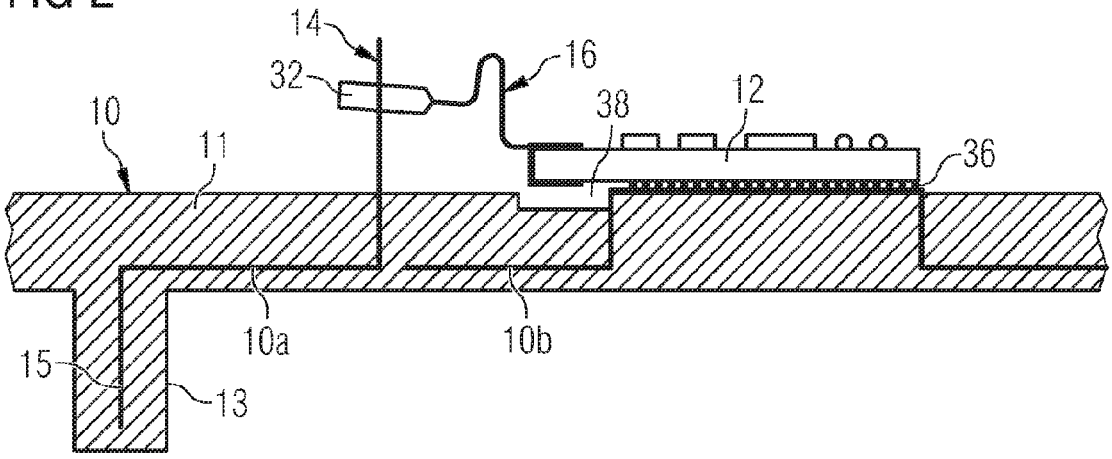
FIG. 2 shows a section through a leadframe with a closed clamping connection according to FIG. 1.

The second contact element 16 is in the form of a flat strip which is fastened at its first end 28 to the printed circuit board 12, forms a flexible intermediate region 30 and at its second end is turned through approximately 90° in the longitudinal direction. This end is in the form of a lug 32 which can be inserted into the slot 22. The second contact element 16 has a U-shaped first end 28 which is pushed onto the printed circuit board 12 and is fastened to the printed circuit board 12 by conductive adhesive bonding or soldering (see FIG. 2). In order to make contact between the first contact element 14 and the second contact element 16, the lug 32 of the second contact element 16 is inserted into the slot 22 of the first contact element 14. This is done mechanically by automatically pressing-in the lug 32 with a defined path. Depending on the control function, the printed circuit board 12 is connected to the leadframe 10 by way of a corresponding number of contacts.

The flexible intermediate region 30 describes a loop 34. As a result, the connection of the two contact elements 14, 16 is relieved of clamping forces. In addition, the second contact element 16 is able, on account of the loop 34, to bridge different distances between the first contact element 14 and the second contact element 16. The conductive, flexible intermediate region 30 may comprise, for example, spring-elastic material.

The edges 35 of the lug 32 are formed with a sharp edge and/or as a burr on that side which is inserted into the slot 22 first. When the lug 32 is inserted into the slot 22, the contact regions of the first contact element are scraped and as a result any impurities which may be present are removed. The first contact element 14 and the second contact element 16 preferably comprise a CuSn alloy and only the region of the lug 32 is tin-plated. If the metal on the contact regions of the first contact tongue 18 and the second contact tongue 20 is somewhat corroded, the edges of the lug 32, which edges are formed with a sharp edge or as a burr, likewise remove the layer of corrosion by scraping and therefore ensure that satisfactory contact is made between the contact regions. A further widened portion 33, which is larger than the clear width between the punctiform and/or linear contact regions 25, 27 which are arranged between the widened portion 24 and the further widened portion 33, is provided at the closed end of the slot 22. As a result, the punctiform and/or linear contact regions 25, 27 also rest against the lug 32 if said lug is thicker at its lower edge and the slot 22 would otherwise open in a V-shaped manner without the further widened portion and consequently there would be no defined contact between the contact elements.

The printed circuit board 12 is adhesively bonded to the leadframe 10, for example by way of an adhesive layer or a film or foil 36 which is adhesive on both sides. In order to cool the printed circuit board 12, provision is made for the leadframe 10 to be in the form of a cooling surface at least in the region in which the printed circuit board 12 is arranged on the leadframe 10. The adhesive film or foil 36 is therefore as thermally conductive as possible. In order to improve the electromagnetic shielding behavior, provision is made for the surface of the leadframe 10 on which the printed circuit board 12 is arranged to be connected to the electrical ground of the component. When the adhesive film or foil 36 is electrically conductive, the contact to ground can be established between the printed circuit board 12 and the leadframe 10 by means of the fastening.

So that a short circuit is not produced between the lower limb of the U-shaped first end 28, which is pushed onto the edge of the printed circuit board 12, and the leadframe 10, a bead 38 is provided at the point of connection of the second contact element 16. In this case, the distance is such that impurities, for example metal swarf or grit from the carbon brushes of an actuating motor which is arranged in the same housing, can be collected in this recess over the course of time, without being able to result in a short circuit.

Instead of the bead 38, cutouts can also be arranged in the leadframe 10. As an alternative, the region of the leadframe 10 on which the printed circuit board 12 is arranged can also be in the form of a raised portion 40, with the printed circuit board 12 projecting beyond the raised portion 40 at the point at which the second contact elements 16 are connected (see FIG. 3).

Figure 3:
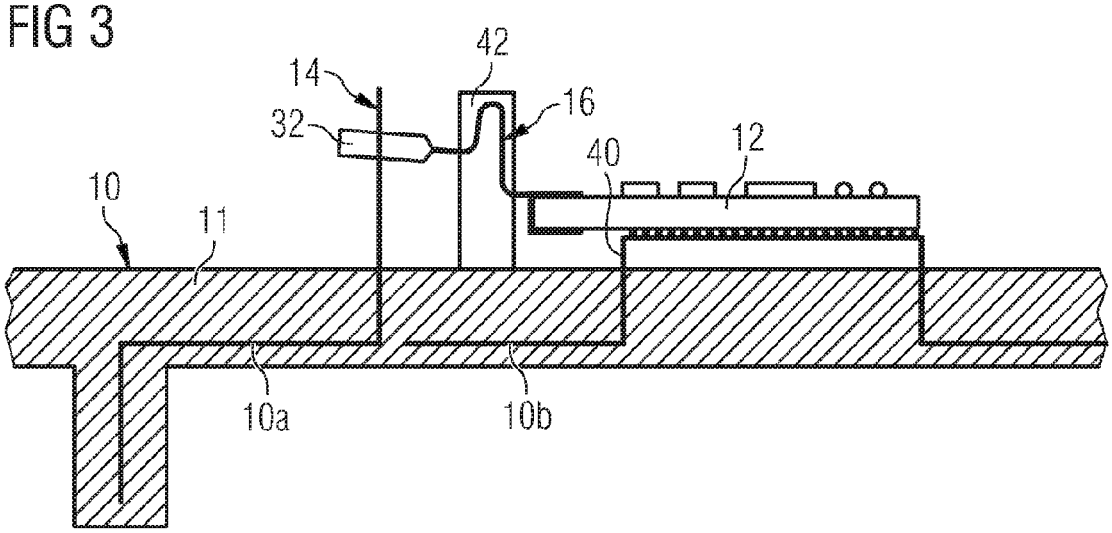
FIG. 3 shows a section through a leadframe according to FIG. 2 with a raised printed circuit board and lateral support of the flexible region.

FIG. 3 shows an exemplary embodiment in which a support 42 is provided next to the flexible intermediate region 30, in order to limit deformation of the intermediate region 30 caused by oscillation or impacts, so that the contact regions are protected against dynamic loads. The flexible intermediate region 30 can also be damped, for example, by elastomers which can be provided on the flexible intermediate region 30 in a further embodiment. The probability of failure of the contact is reduced to a minimum by reducing relative movements of the contact points in relation to one another.

The invention claimed is:

1. A component part comprising an electrical printed circuit board which has an electronic circuit and with which a leadframe makes electrical contact, wherein the printed circuit board is fitted on the leadframe and forms a unit with said leadframe, first contact elements which can be plug-connected to second contact elements on the printed circuit board via a flexible intermediate region project from the leadframe next to the printed circuit board, and the first and the second contact elements make contact with one another in pairs in such a way that in each case at least one punctiform and/or linear contact region on one contact element interacts with a flat contact region on the other contact element with a spring-elastic clamping connection, with the flat contact region being in the form of a contact lug on the flexible intermediate region, and the punctiform and/or linear contact regions being formed by two contact tongues which are opposite one another by way of narrow sides which bound a slot, and at least one of the contact tongues being spring-elastic and the slot being elastically widened by the inserted contact lug.

2. The component part according to claim 1, wherein the slot has a widened portion at its open end.

3. The component part according to claim 1, wherein one of the two contact tongues forms a straight, linear contact region, and the other of the two contact tongues has on its slot flank a projection which forms a round or pointed, punctiform contact region.

4. The component part according to claim 1, wherein the second contact element is in the form of a flat strip which is fastened at its first end to the printed circuit board, forms the flexible intermediate region and at its second end is turned through approximately 90° in the longitudinal direction and is inserted into the slot as the contact lug.

5. The component part according to claim 4, wherein the edges of the contact lug are formed with a sharp edge and/or as a burr on that side which was inserted into the slot first.

6. The component part according to claim 1, wherein the flexible intermediate region describes at least one loop.

7. The component part according to claim 1, wherein the flexible intermediate region is damped against oscillations.

8. The component part according to claim 1, wherein a support is provided for the flexible intermediate region.

9. The component part according to claim 1, wherein the electrically conductive edge region of the printed circuit board with which contact is made is arranged at a distance from the leadframe.

10. The component part according to claim 1, wherein the first contact elements are in each case in the form of the contact tongues, and the second contact elements are in the form of the contact lug with the flexible intermediate region.

11. The component part according to claim 1, wherein the leadframe forms continuous electrical connections between the first contact elements and the contacts of an electrical connector which is provided on the outside of the component.

12. The component part according to claim 1, wherein the printed circuit board is held on the leadframe.

13. The component part according to claim 12, wherein the leadframe is in the form of a heat sink at least in the region of the printed circuit board, and the printed circuit board is connected to the leadframe in a thermally conductive manner.

14. The component part according to claim 12, wherein the printed circuit board is adhesively bonded to the leadframe.

15. A method for mounting an electrical printed circuit board having an electronic circuit on a leadframe which is at least partially surrounded by plastic, the method comprising the steps of:

fitting the printed circuit board flat on the leadframe, mechanically connecting first contact elements, which project next to the printed circuit board, to second contact elements on the printed circuit board in pairs by means of a flexible intermediate region, and connecting in each case at least one punctiform and/or linear contact region on one contact element to a flat contact region on the other contact element by way of a spring-elastic clamping connection.

16. The method according to claim 15, wherein the printed circuit board is fitted on the leadframe and contact is made with the contact elements in a single working step.

17. The method according to claim 15, wherein the flat contact region, which is in the form of a contact lug on the flexible intermediate region is inserted into a slot which is formed by two contact tongues whose narrow sides are opposite one another and which represent punctiform and/or linear contact regions, and the slot is elastically widened by the inserted lug.

18. A method for using of a component part comprising an electrical printed circuit board which has an electronic circuit and with which a leadframe makes electrical contact, wherein the printed circuit board is fitted on the leadframe and forms a unit with said leadframe, first contact elements which can be plug-connected to second contact elements on the printed circuit board via flexible intermediate region project from the leadframe next to the printed circuit board, and the first and second contact elements make contact with one another in pairs in such a way that in each case at least one punctiform and/or linear contact region on one contact element interacts with a flat contact region on other contact element a spring-elastic clamping connection, with the flat contact region being in the form of a contact lug on the flexible intermediate region, and the punctiform and/or linear contact regions being formed by two contact tongues which are opposite one another by way of narrow sides which bound a slot, and at least one of the contact tongues being spring-elastic and the slot being elastically widened by the inserted contact lug, the method comprising the step of using the component part as a housing cover of an actuator.

* * * * *